US006224444B1

(12) United States Patent
Klimenko

(10) Patent No.: US 6,224,444 B1
(45) Date of Patent: May 1, 2001

(54) INFLATABLE CHAIR OR OTHER STRUCTURE ADAPTED FOR CERTAIN TYPES OF USE IN WATER

(75) Inventor: Konstantin Klimenko, Los Angeles, CA (US)

(73) Assignee: Sevylor U.S.A., Inc., Los Angeles, CA (US)

( * ) Notice: Subject to any disclaimer, the term of this patent is extended or adjusted under 35 U.S.C. 154(b) by 0 days.

(21) Appl. No.: 09/410,502

(22) Filed: Oct. 1, 1999

(51) Int. Cl.[7] ..... B63B 35/74
(52) U.S. Cl. ..... 441/130; 297/452.41
(58) Field of Search ..... 441/129–132, 441/126; 297/452.41

(56) References Cited

U.S. PATENT DOCUMENTS

| | | | | |
|---|---|---|---|---|
| D. 187,313 | * | 2/1960 | Denyer | 441/132 |
| 2,623,574 | * | 12/1952 | Damsch | 441/126 |
| 2,803,839 | * | 8/1957 | Mosley | 441/131 |
| 3,117,327 | * | 1/1964 | Mathew | 441/132 |
| 4,601,667 | * | 7/1986 | Hull | 441/131 |
| 4,687,452 | * | 8/1987 | Hull | 441/131 |
| 4,905,332 | * | 3/1990 | Wang | 441/130 |
| 4,938,722 | * | 7/1990 | Rizley | 441/131 |
| 5,507,674 | * | 4/1996 | Yeung | 441/131 |
| 5,951,111 | | 9/1999 | Klimenko | 297/452.41 |
| 6,059,360 | * | 5/2000 | Bedard | 441/130 |
| 6,086,150 | * | 5/2000 | Scheurer et al. | 441/130 |

* cited by examiner

*Primary Examiner*—Sherman Basinger
(74) *Attorney, Agent, or Firm*—Dean W. Russell; Kilpatrick Stockton LLP

(57) ABSTRACT

Inflatable objects such as (but not necessarily) chairs are disclosed. The objects may have enhanced stability for use in bodies of calm water such as swimming pools, including either or both of outrigger-style floats or pontoons and roll-up mattresses. Fittings, when present, may allow attachment and detachment of the pontoons and roll-up mattresses and connection of one inflatable object to one or more others.

27 Claims, 3 Drawing Sheets

INFLATABLE CHAIR OR OTHER STRUCTURE ADAPTED FOR CERTAIN TYPES OF USE IN WATER

FIELD OF THE INVENTION

This invention relates to structures for supporting humans either seated, reclining, or otherwise not standing upright and more particularly to inflatable chairs and similar furniture adapted for recreational use in pools or other bodies of calm water.

BACKGROUND OF THE INVENTION

Commonly-owned U.S. Pat. No. 5,951,111 to Klimenko, incorporated herein in its entirety by this reference, illustrates and describes bodies of furniture typically referred to as chairs and sofas. As detailed in the Klimenko patent, these bodies are inflatable, with valves provided for filling enclosed inner spaces within the bodies with air. The bodies additionally may include internal support beams (made usually of plastic material) and contain one or more plastic containers in their armrest portions or otherwise.

Although adapted for myriad uses, certain commercial versions of the inflatable structures of the Klimenko patent are not optimized for use in bodies of water such as swimming pools. For example, the commercial versions lack low-riding ballast and accordingly have relatively high centers of gravity. This in turn contributes to likely instability should the structures be used in pools, as users would have difficulty maintaining the balance of the structures when they are seated. The assignee of the Klimenko patent thus does not market commercial versions for use in bodies of water (whether calm, like pools, or otherwise).

SUMMARY OF THE INVENTION

The present invention, by contrast, provides inflatable structures with greater stability for use in bodies of generally-calm water such as swimming pools. Examples of stability-enhancing components of the structures are outrigger-style pontoons (floats) and roll-up (and foldable) mattresses, each of which may be inflated if appropriate to do so. These components additionally need not inhibit use of the structures in other circumstances, such as on beaches and by poolsides. Some or all of the components may be detachable, moreover, if necessary or desired. Likewise, the structures may contain fittings (connectors) allowing them to be linked one to the others, typically (but not necessarily) side-by-side.

In some embodiments of the invention, the inflatable structures are chairs having seat and back portions as well as armrests. Incorporated into one or more armrests may be cupholders of the type illustrated in the Klimenko patent, although other cupholders may be used instead if desired or such cupholders alternatively may be omitted. Made primarily of polyvinyl chloride (PVC), these embodiments of the chairs are formed into more than one internal compartment. As a consequence, the compartments may be inflated (with air) separately or, preferably, one may be filled with water to create ballast. In the latter case, the ballast-containing compartment typically is intended to be underneath the seat portions of the chairs.

Fittings may be included on any or all of the front, back, and sides of the chairs. Certain embodiments containing fittings have them on each of the front, back, and sides, with those on the back designed to permit attachment of an inflatable outrigger pontoon for improved balance on water.

If a mattress is attached to a chair (preferably—although not necessarily—permanently), front fittings may be used to help retain the mattress in a rolled-up position, while side fittings permit one chair to be connected to another chair (or other object) on either or both of its sides. Those skilled in the art will, of course, recognize that fittings need not necessarily be included anywhere on structures of the present invention and that, if included, may be of any type suitable for the purposes for which the structures are to be used.

Pontoons attachable to structures of the invention may themselves be inflated with air or, if desired, filled otherwise with liquid, solid, or gaseous substances. Appropriate inflation or filling of the pontoons can enhance stability of the structures to which they are attached, especially when the structures are used to support seated persons in swimming pools. As well, the pontoons typically may be detached from the chairs of the invention, facilitating deflation and storage of both the chairs and the pontoons.

Attachable mattresses of the present invention likewise are usually inflated with air. Designed to function in at least three positions, the mattresses may in many cases improve the balance and consequent stability of the inflatable chairs when used in swimming pools. When rolled up, for example, a mattress forms an outrigger adjacent the front of its corresponding chair, assisting the pontoon to maintain the balance of the chair in water. The mattress can also be unrolled to receive and support human legs above the water line, again facilitating balancing of the chair as the user stretches his or her legs. In a third position, the mattress may be folded underneath and attached to the bottom of a chair as, for example, when the chair is to be used poolside or stored. Embodiments of the structures of the present invention may further include braided cords or other suitable means permitting the structures to be tied down in windy or other adverse conditions.

It is therefore an object of the present invention to provide inflatable recreational structures with enhanced stability in bodies of water such as swimming pools.

It is another object of the present invention to provide inflatable chairs and other objects to which one or more pontoons may be attached as outriggers.

It is an additional object of the present invention to provide inflatable structures to which inflatable mattresses may be attached.

It is a further object of the present invention to provide inflatable structures having ballast compartments and in which the mattresses may be utilized in multiple positions, including as rolled-up, unrolled, or folded underneath the structures.

It is also an object of the present invention to provide inflatable structures which may include fittings on one or more sides, such fittings facilitating attachment of each structure to other like structures and objects including pontoons and mattresses.

It is yet another object of the present invention to provide inflatable structures having armrests incorporating cupholders.

Other objects, features, and advantages of the present invention will become apparent with reference to the remainder of the text and the drawings of this application.

DETAILED DESCRIPTION

Figure 1:
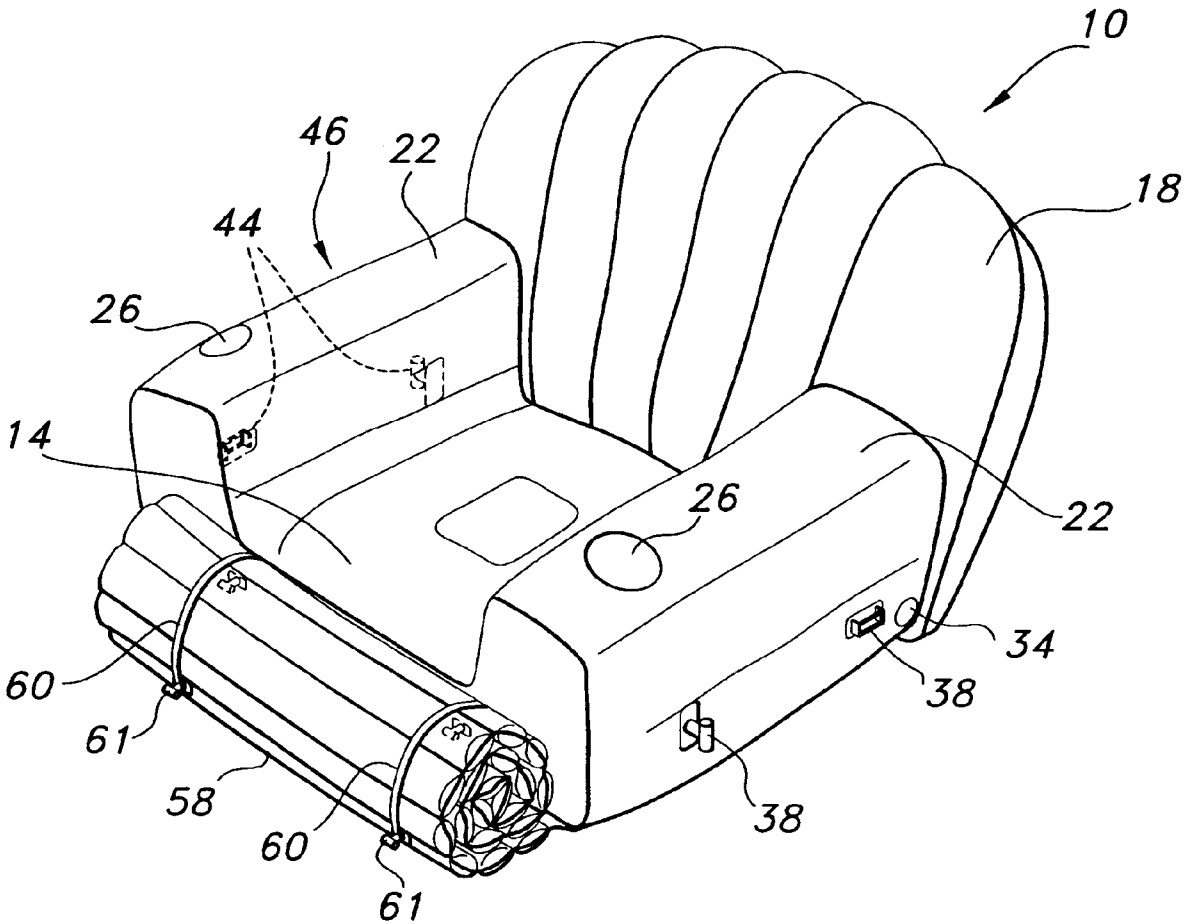
FIG. 1 is a perspective view of an inflatable chair consistent with the present invention showing an attached mattress in its rolled-up position.
Figure 2:
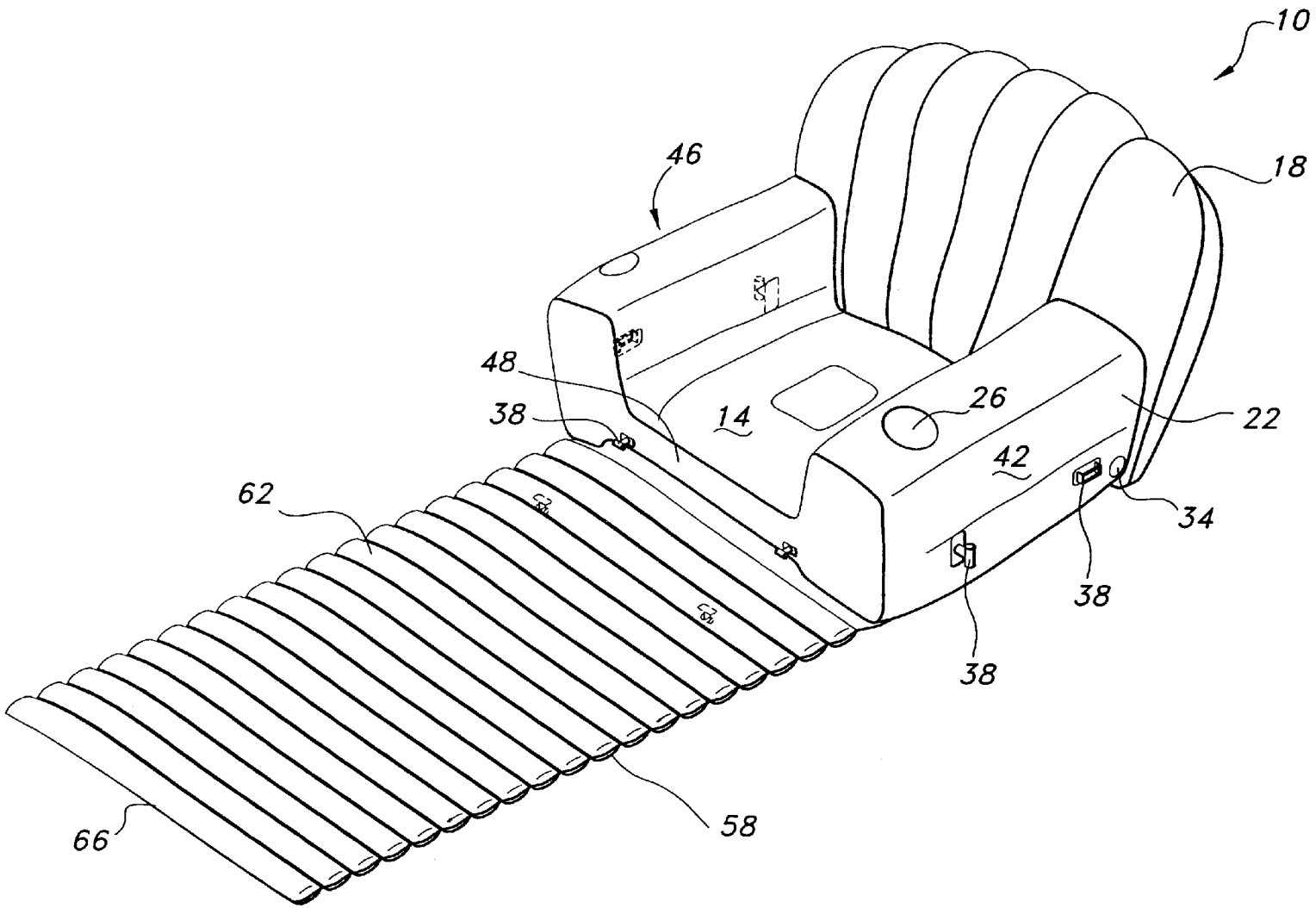
FIG. 2 is a perspective view of the chair of FIG. 1 illustrating the attached mattress in an unrolled position.
Figure 3:
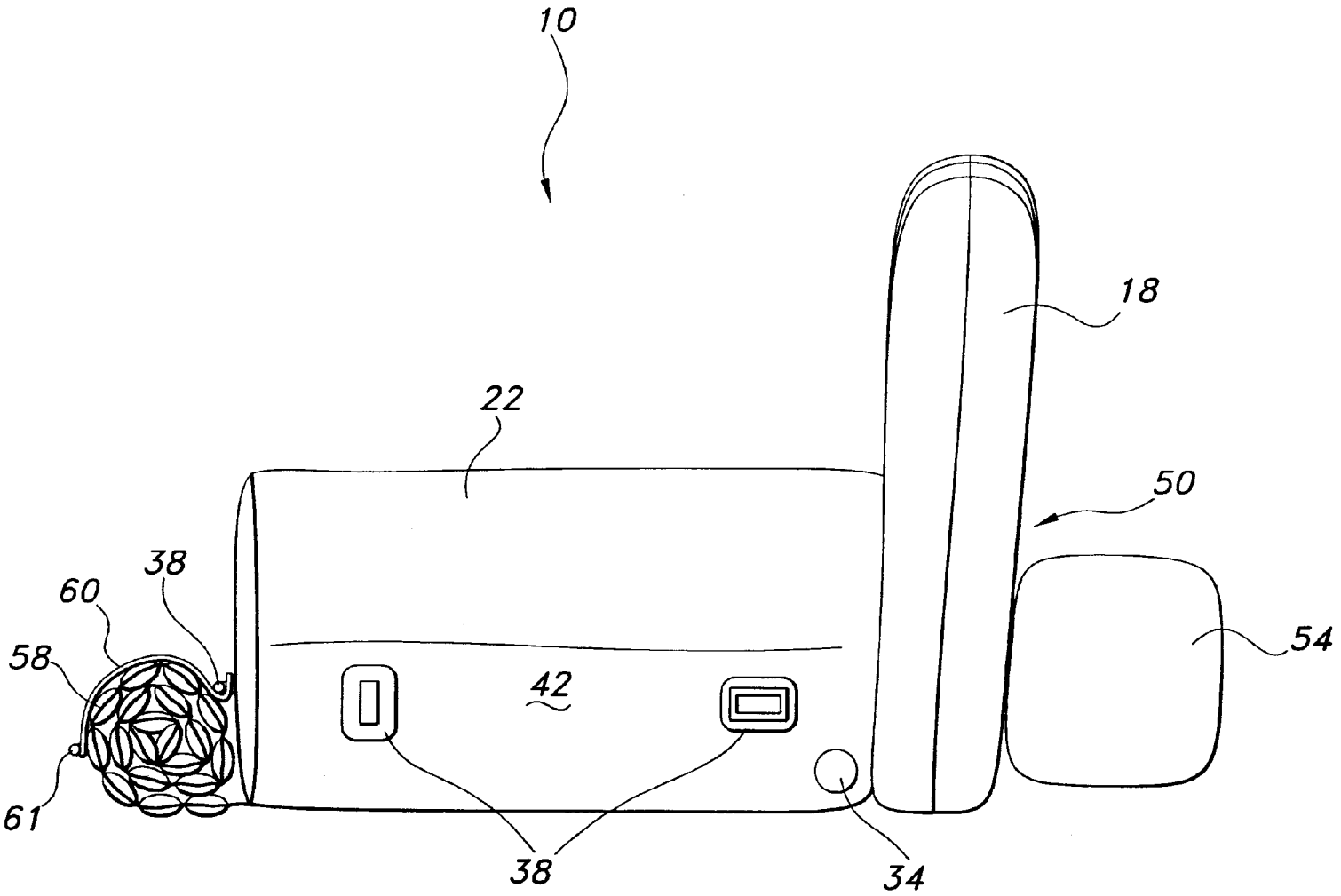
FIG. 3 is a side elevational view of the chair of FIG. 1 showing an attached outrigger pontoon extending from its back.

FIGS. 1–3 detail an inflatable structure of the present invention in the exemplary form of chair 10. Chair 10 typically comprises seat 14, back 18, and one or more armrests 22, although it may be configured otherwise without deviating from the purposes of the invention. If desired, cupholders 26, either similar to or differing from those of the Klimenko patent, may be included in any of armrests 22 or elsewhere as part of chair 10.

Any or all of chair 10 may be made of plastic material such as PVC. The PVC initially may exist in sheet form, with various sheets being connected to each other typically using conventional radio-frequency (RF) welding techniques to form one or more air-impervious chambers or compartments. Those skilled in the art will, of course, recognize that materials other than PVC may be used to create chair 10 and numerous methods of forming those materials into a structure such as chair 10 exist. Nevertheless, in certain preferred embodiments of chair 10, each of seat 14, back 18, and armrests 22 is made of PVC.

In these embodiments, moreover, the sheets of PVC are connected so as to form two distinct, non-communicating internal compartments. One internal compartment, effectively comprising the interior regions of back 18, armrests 22, and part of seat 14, is designed to be inflated with air through valve 34. The other internal compartment, by contrast, includes the remainder of the interior region of seat 14 and is intended usually to be filled with water (through an unshown valve, plug, drain, or other component in the bottom of chair 10) for ballast. Again, however, those skilled in the art will understand that chair 10 may have fewer or greater numbers of internal compartments than as detailed for these particular preferred embodiments.

Additionally shown in FIGS. 1–3 are fittings 38, one or more of which may be incorporated into chair 10 in any suitable location. FIGS. 1–3, for example, illustrate an exemplary pair of fittings 38 present in side 42 of armrest 22. Often, although not necessarily, complementary (e.g. male and female) fittings 44 will be present in the opposite side 46 of chair 10, if so, two identical chairs 10 may be linked together side-by-side by connecting fittings 38 from one chair 10 with fittings 44 from another.

Fittings 38 also may be placed on front 48 and rear 50 of chair 10. Fittings 38 on rear 50 may be adapted to receive and retain complementary fittings on outrigger-style float or pontoon 54, effectively securing pontoon 54 to the rear 50 of chair 10. Embodiments of pontoon 54 may be adapted to be inflated (typically with air) or otherwise filled through any valve or other component suitable for that purpose, enabling the pontoon 54 to assist in stabilizing an inflated chair 10 when placed in water. Various embodiments of chair 10 may include more than one pontoon 54 connected to any of its front 48, rear 50, or sides 42 or 46. Preferably, however, pontoons 54 are connected solely to rear 50, with mattress 58 instead being connected by RF welding (or otherwise) to front 48.

FIGS. 1 and 3 show mattress 58 as rolled-up, with FIG. 3 especially illustrating its positioning opposite chair 10 from pontoon 54. As positioned, mattress 58, together with pontoon 54 (and any ballast contained within chair 10), reduces the possibility of chair 10 rolling forward or backward in water when a person sits on seat 14. Mattress 58 thus can function at least to some extent as an outrigger like pontoon 54. Components such as (but not limited to) cord 60 and fittings or hooks 61, together with fittings 38, may be used to retain mattress 58 in the rolled-up position.

FIG. 2, by contrast, details unrolled mattress 58. When unrolled and inflated with air (through a valve or other suitable mechanism), mattress 58 is adapted to support the legs of a person seated in chair 10. In this position mattress 58 again assists in stabilizing chair 10 in water, as supporting the stretched-out legs of a seated person helps retain the overall balance of chair 10 in the pool or other body of water. Although not illustrated in FIG. 2, mattress 58 additionally may be folded in the area of its midsection 62 back under chair 10, so that end 66 of mattress 58 is proximate rear 50. This third position of mattress 58 is particularly useful should chair 10 be used on land (e.g. poolside) or stored for an extended period. Moreover, if mattress 58 contains fittings near end 66, they may be attached to any complementary fittings present on the bottom of chair 10 to retain the mattress 58 in this folded position.

The foregoing has been provided for purposes of illustrating, explaining, and describing embodiments of the present invention. Further modifications and adaptations to these embodiments will be apparent to those skilled in the art and may be made without departing from the scope or spirit of the invention.

I claim:

1. An inflatable structure for use in water to support at least a portion of a person, the inflatable structure comprising:

a. an inflatable member having a front and a rear and adapted to support at least a portion of the person in a seated position, the inflatable member comprising:
   i. a seat portion defining the front; and
   ii. a back portion having a first face adapted to be contacted in use by the back of the seated person and a second face opposite the first face, the second face defining the rear; and b. a stabilizing float attached to the rear of the inflatable member so as to contact the water and stabilize the inflatable member when the back portion is upright.

2. An inflatable structure according to claim 1 in which the stabilizing float is inflatable.

3. An inflatable structure according to claim 2 in which the stabilizing float is detachable from the rear of the inflatable member.

4. An inflatable structure according to claim 1 in which the stabilizing float is detachable from the rear of the inflatable member.

5. An inflatable structure according to claim 1 in which the stabilizing float has a cross-section that is generally rectangular.

6. An inflatable structure according to claim 1 in which the back portion has an interior inflatable with air and the seat portion has an interior adapted to receive ballast in the form of a material other than air.

7. An inflatable structure according to claim 1 further comprising a plurality of fittings adapted to connect the inflatable structure to a second structure having complementary fittings.

8. An inflatable structure according to claim 1 further comprising at least one armrest portion.

9. An inflatable structure according to claim 8 in which the armrest portion is inflatable and has a cupholder incorporated therein.

10. An inflatable structure according to claim 1 in which each of the stabilizing float and the rear of the inflatable member includes at least one fitting, the fittings being complementary so as to allow attachment of the stabilizing float to the rear of the inflatable member.

11. An inflatable structure according to claim 1 further comprising an inflatable mattress attached to the front of the inflatable member.

12. An inflatable structure according to claim 11 in which the inflatable mattress is configured so as to be rolled up to form a stabilizing pontoon adjacent the front of the inflatable member and unrolled to receive and support the legs of the seated person.

13. An inflatable structure according to claim 12 further comprising a cord contacting the inflatable mattress and facilitating retention of the inflatable mattress in the rolled-up position.

14. An inflatable structure according to claim 1 in which the inflatable member is a chair.

15. An inflatable structure according to claim 11 in which the inflatable mattress lacks fluid communication with and thus is separately inflatable from the inflatable member.

16. An inflatable structure for supporting at least a portion of a person, the inflatable structure comprising:

a. an inflatable member having a front and a rear and adapted to support at least a portion of the person in a seated position, the inflatable member comprising:
   i. a seat portion defining the front; and
   ii. a back portion having a first face adapted to be contacted in use by the back of the seated person and a second face opposite the first face, the second face defining the rear; and b. a mattress attached to the front of the inflatable member and configured so as to be rolled up to form a stabilizing pontoon adjacent the front of the inflatable member and unrolled to receive and support the legs of the seated person.

17. An inflatable structure according to claim 16 in which the mattress is detachable from the front of the inflatable member.

18. An inflatable structure according to claim 16 further comprising a cord contacting the mattress and facilitating retention of the mattress in the rolled-up position.

19. An inflatable structure according to claim 16 in which the mattress can be folded underneath the seat portion of the inflatable member.

20. An inflatable structure according to claim 16 in which the mattress is inflatable.

21. An inflatable structure according to claim 16 in which the inflatable member is a chair.

22. An inflatable structure for use in water to support at least a portion of a person, the inflatable structure comprising:

a. an inflatable member having a front and a rear and adapted to support at least a portion of the person in a seated position, the inflatable member comprising:
   i. a seat portion defining the front; and
   ii. a back portion having a first face adapted to be contacted in use by the back of the sea ed person and a second face opposite the first face, the second face defining the rear;

b. a stabilizing float attached to the rear of the inflatable member so as to contact the water and stabilize he inflatable member when the back portion is upright; and c. a mattress attached to the front of the inflatable member.

23. An inflatable structure according to claim 22 in which the inflatable member is a chair.

24. An inflatable structure for use in water to support at least a portion of a person, the inflatable structure comprising:

a. an inflatable member having a front and a rear and adapted to support at least a portion of the person in a seated position, the inflatable member comprising:
   i. a seat portion de fining the front; and
   ii. a back portion having a first face adapted to be con acted in use by the back of the seated person and a second face opposite the first face, the second face defining (A) the rear, (B) an upper portion, and (C) lower portion which is beneath the upper portion and contacts the water when the back portion is upright; and b. a stabilizing float attached to the inflatable member so as to extend behind the lower portion of the second face of the back portion thereof.

25. An inflatable structure for use in water to support at least a portion of a person, the inflatable structure comprising:

a. an inflatable member having a front and a rear and adapted to support at least a portion of the person in a seated position, the inflatable member comprising:
   i. an inflatable seat portion having opposed first and second sides; and
   ii. an inflatable back portion integral with the inflatable seat portion and extending upward therefrom; and b. at least two stabilizing floats, at least one of which is attached to the first side of the inflatable seat portion and at least another of which is attached to the second side of the inflatable seat portion, so that the at least two stabilizing floats contact the water and stabilize the inflatable member when the back portion is upright.

26. An inflatable structure for supporting at least a portion of a person, the inflatable structure comprising:

a. an inflatable member having a front and a rear and adapted to support at least a portion of the person in a seated position, the inflatable member comprising:
   i. a seat portion defining the front; and
   ii. a back portion having a first face adapted to be contacted in use by the back of the seated person and a second face opposite the first face, the second face defining the rear; and b. a stabilizing float attached to the rear of the inflatable member, the stabilizing float being detachable from and reattachable to the rear of the inflatable member.

27. An inflatable structure for supporting at least a portion of a person, the inflatable structure comprising:

a. an inflatable member having a front and a rear and adapted to support at least a portion of the person in a seated position, the inflatable member comprising:
   i. a seat portion defining the front; and
   ii. a back portion having a first face adapted to be contacted in use by the back of the seated person and a second face opposite the first face, the second face defining (A) the rear, (B) an upper portion, and (C) a lower portion which is beneath the upper portion when the back portion is upright; and b. a stabilizing float connected to solely the lower portion of the second face of the back member.

* * * * *